US011584600B2

(12) United States Patent
Scheffler

(10) Patent No.: US 11,584,600 B2
(45) Date of Patent: Feb. 21, 2023

(54) DEVICE FOR PROCESSING OF FLAT ELEMENTS AND CONVEYOR BELT FOR USE IN SUCH A DEVICE

(71) Applicant: Jörg Scheffler, Karlsruhe (DE)

(72) Inventor: Jörg Scheffler, Karlsruhe (DE)

( * ) Notice: Subject to any disclaimer, the term of this patent is extended or adjusted under 35 U.S.C. 154(b) by 0 days.

(21) Appl. No.: 17/268,139

(22) PCT Filed: Aug. 8, 2019

(86) PCT No.: PCT/EP2019/071355
§ 371 (c)(1),
(2) Date: Feb. 12, 2021

(87) PCT Pub. No.: WO2020/035396
PCT Pub. Date: Feb. 20, 2020

(65) Prior Publication Data

US 2021/0300699 A1 Sep. 30, 2021

(30) Foreign Application Priority Data

Aug. 16, 2018 (DE) ..... 10 2018 119 971.6

(51) Int. Cl.
*B65H 5/22* (2006.01)
*B65H 43/00* (2006.01)

(52) U.S. Cl.
CPC ..... *B65H 5/224* (2013.01); *B65H 43/00* (2013.01); *B65H 2301/531* (2013.01); *B65H 2401/15* (2013.01); *B65H 2404/1151* (2013.01); *B65H 2404/222* (2013.01); *B65H 2404/2532* (2013.01); *B65H 2404/27* (2013.01); *B65H 2404/271* (2013.01); *B65H 2404/28* (2013.01); *B65H 2406/3662* (2013.01); *B65H 2511/13* (2013.01); *B65H 2801/84* (2013.01)

(58) Field of Classification Search
CPC ..... B65H 5/224; B65H 2406/3662; B65H 2404/27; B65H 2404/2532; B65H 2404/222; B65H 2404/1151; B65H 2301/531; B65G 15/48; B26D 2007/322
See application file for complete search history.

(56) References Cited

U.S. PATENT DOCUMENTS

| | | | |
|---|---|---|---|
| 2,109,079 | A | 2/1938 | Zeigler |
| 2,347,430 | A | 4/1944 | O'brien |
| 2,917,768 | A | 12/1959 | Walberer |

(Continued)

FOREIGN PATENT DOCUMENTS

| | | | |
|---|---|---|---|
| EP | 3196036 | A1 | 7/2017 |
| WO | 2014121939 | A1 | 8/2014 |

*Primary Examiner* — Jeremy R Severson
(74) *Attorney, Agent, or Firm* — Rabin & Berdo, P.C.

(57) ABSTRACT

A device for processing of flat elements, especially for the processing of paper blanks, is described. This device comprises a conveyor belt (25) that is guided over a first roller (12*a*) and a second roller (12*b*), said conveyor belt being made of metal and being permeable to air, wherein its upper section forms the transport section (25*a*) and its lower section forms the return section (25*b*), and a vacuum generator being located under the upper section of the conveyor belt. A laser (30) for cutting the flat elements is located above the transport section (25*a*). In order to achieve an improved flatness and an increased durability, the conveyor belt (25) consists of an expanded metal.

19 Claims, 4 Drawing Sheets

(56) References Cited

U.S. PATENT DOCUMENTS

Figure 1:
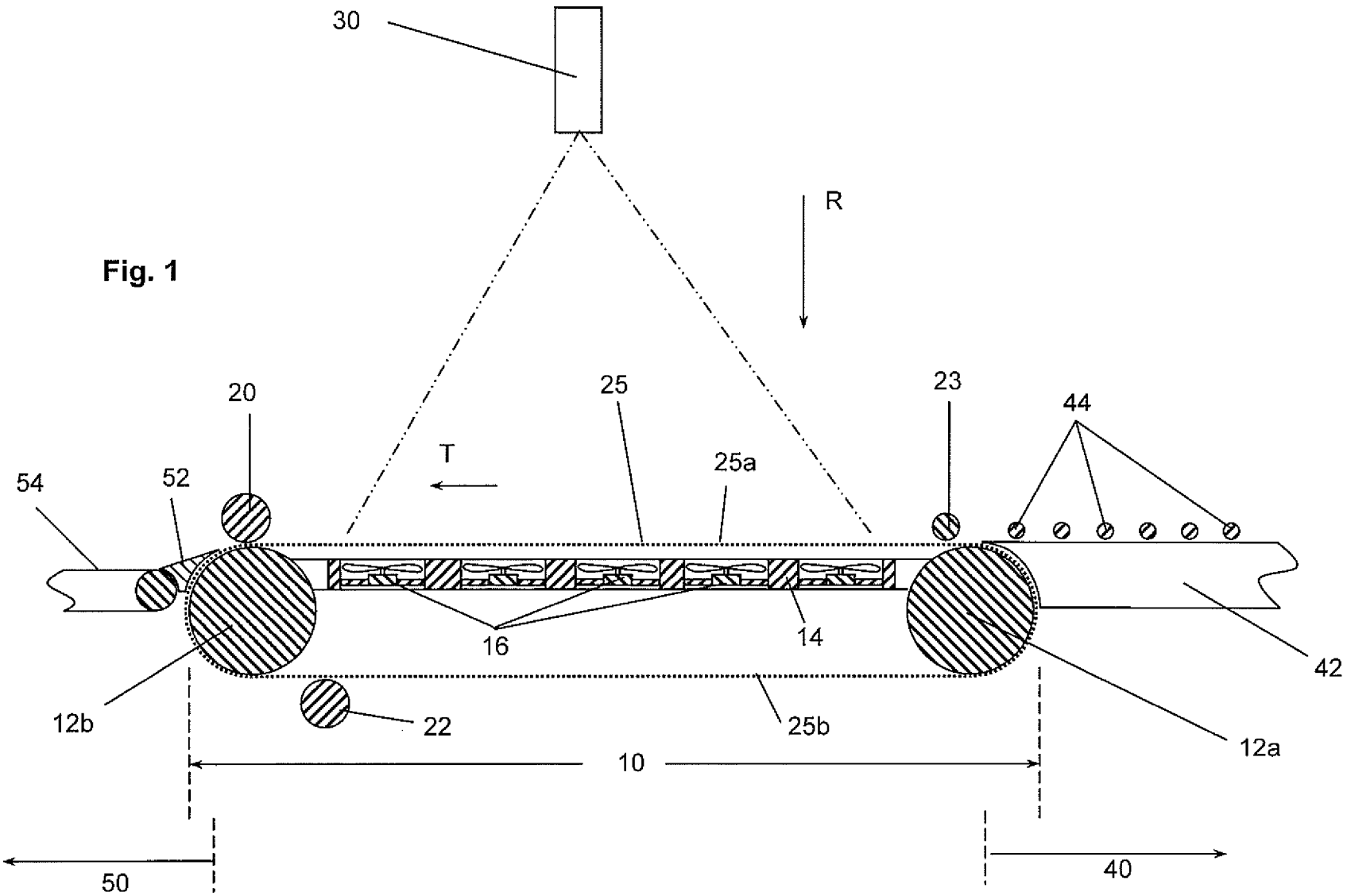

| | | | | |
|---|---|---|---|---|
| 6,095,218 | A * | 8/2000 | Delmolino | B65C 9/1815 156/542 |
| 7,544,384 | B2 * | 6/2009 | Issaev | H01M 4/16 427/361 |
| 9,688,474 | B2 * | 6/2017 | Dinauer | B23K 26/32 |
| 9,725,851 | B2 | 8/2017 | Scheffler | |
| 10,766,039 | B2 * | 9/2020 | Yuge | B03C 3/47 |
| 2009/0017203 | A1 * | 1/2009 | Hada | C09K 19/2007 427/162 |

* cited by examiner

DEVICE FOR PROCESSING OF FLAT ELEMENTS AND CONVEYOR BELT FOR USE IN SUCH A DEVICE

TECHNICAL FIELD OF THE INVENTION

The invention relates to a device for processing flat elements according to the preamble of claim 1, as well as to a conveyor belt for use in such a device.

According to the prior art, so-called suction belts are known for moving paper or other flat elements that must be precisely positioned. Suction belts of this type generally are made of rubber or a similar material and are provided with a multitude of holes. The transport device comprises at least two rollers over which this suction belt moves, while a so-called suction box that can be subjected to a vacuum or low pressure is installed below the upper section of this suction belt which functions as conveyor belt (meaning below the transport section of the conveyor belt). The top surface of the suction box contains numerous openings, so that the vacuum effective in the suction box on the one hand pulls the transport section against the suction box and, on the other hand, pulls the paper located on the surface of the transport section against this surface.

Laser cutting systems are furthermore known in the art which can be used to cut extremely precise contours from paper, for example to create letters, numbers or other symbols in the form of cutouts. Of course, with these systems the paper must also be placed and/or transported precisely positioned, relative to the laser, so that the use of corresponding suction belts make sense as well. As a result of the high thermal stresses caused by the laser, however, the use of conventional suction belts, in particular those made of rubber or a rubber-type material, is not possible and/or would result in extremely high wear.

For solving this problem it is known from generic WO 2014/121939 A1 to use a conveyor belt made of a metal webbing.

Starting therefrom, it is the object of the present invention to further improve a generic device.

This object is solved with a device having the features as disclosed in claim 1.

According to the invention the conveyer belt also consist of a metal, but not of a webbing, but of an expanded metal. Panels of expanded metal are manufactured industrially in a large scale. In doing so, a sheet of metal is passed through rollers, therein a least one of those rollers shows a plurality of teeth which penetrate through the metal sheet, such that a regular pattern of holes is generated. Those holes are often in a form of rhombuses. In a subsequent step the so manufactured expanded metal can be calendered, meaning that it is pressed through two rollers being so arranged that a slit is provided between those two rollers. Elements made of expanded metal are used for various applications, for example as filters or carrier for filters or cladding elements. Nearly all applications known so far is in common, that the elements made of expanded metal are used purely statically.

It turned out that endless belts made of expanded metal are very good suitable for the above described purpose under various aspects. They have a very good flatness, meaning only little arching in the transportation area, are very durable and show a good scattering behavior regarding the impacting laser light, which enhances the quality of the manufactured products. Further the belts can easily be cleaned.

Especially suitable types of expanded metal are defined in claims 2 to 10.

The axles of the two pulleys of the conveyer belt are usually located in one plane. In order to prevent a "side drifting" of the conveyer belt, it is preferred to support the axle of one pulley pivotable within this plane, such that the angle between the axles of the pulleys is changeable. Further preferred, an adjusting device for adjusting this axle is provided, which further preferably is a part of a control loop. Usually it is sufficient and also preferred to only adjust the not driven axle.

Figure 2:
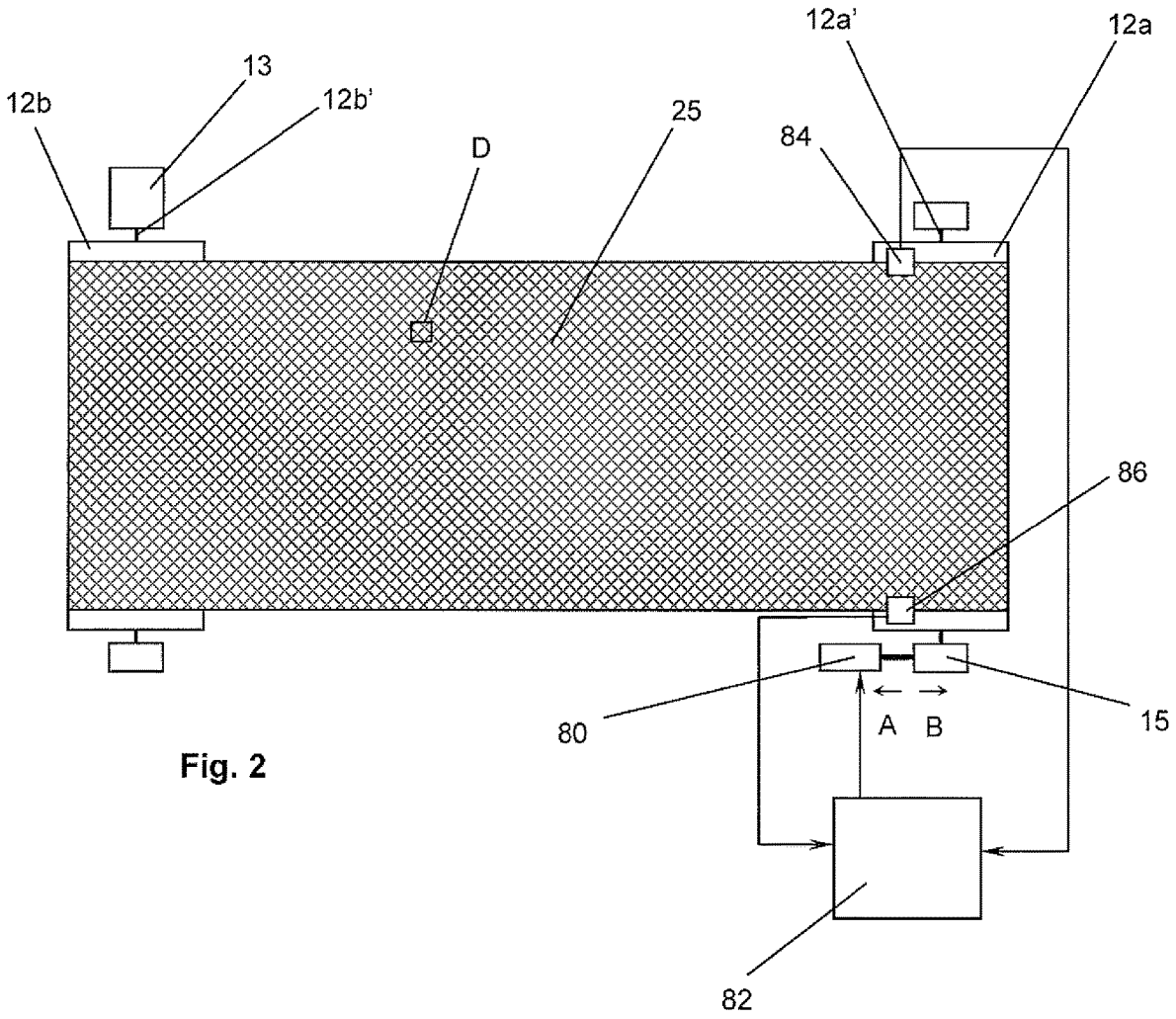
Figure 3:
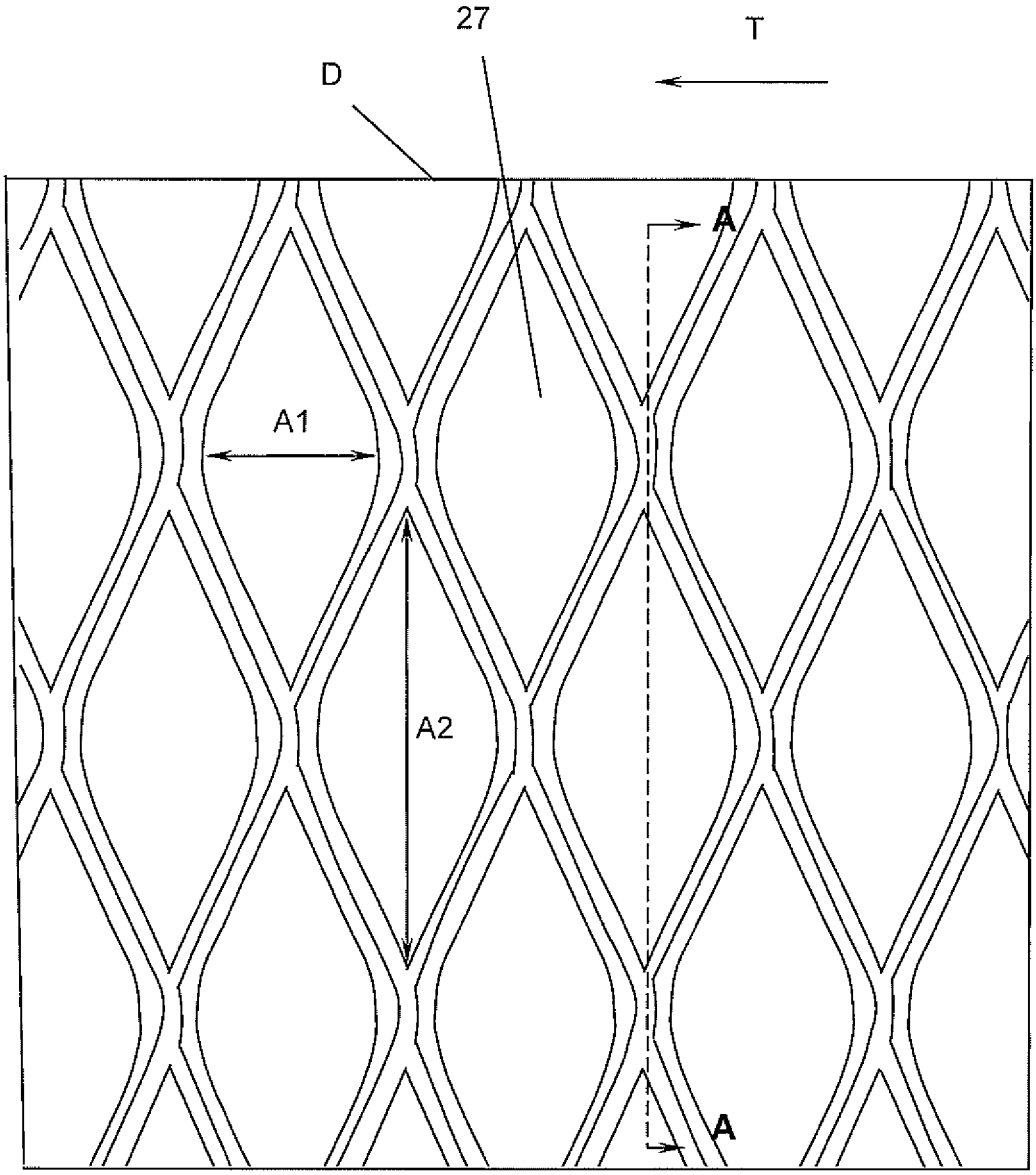
Figure 4:
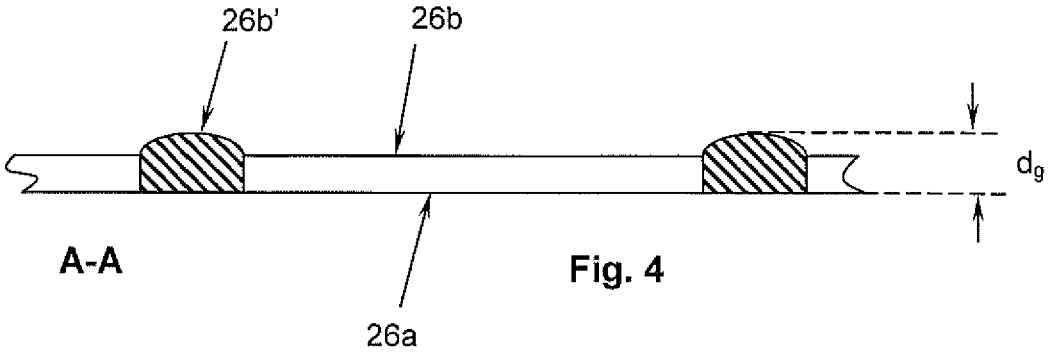
Figure 5:
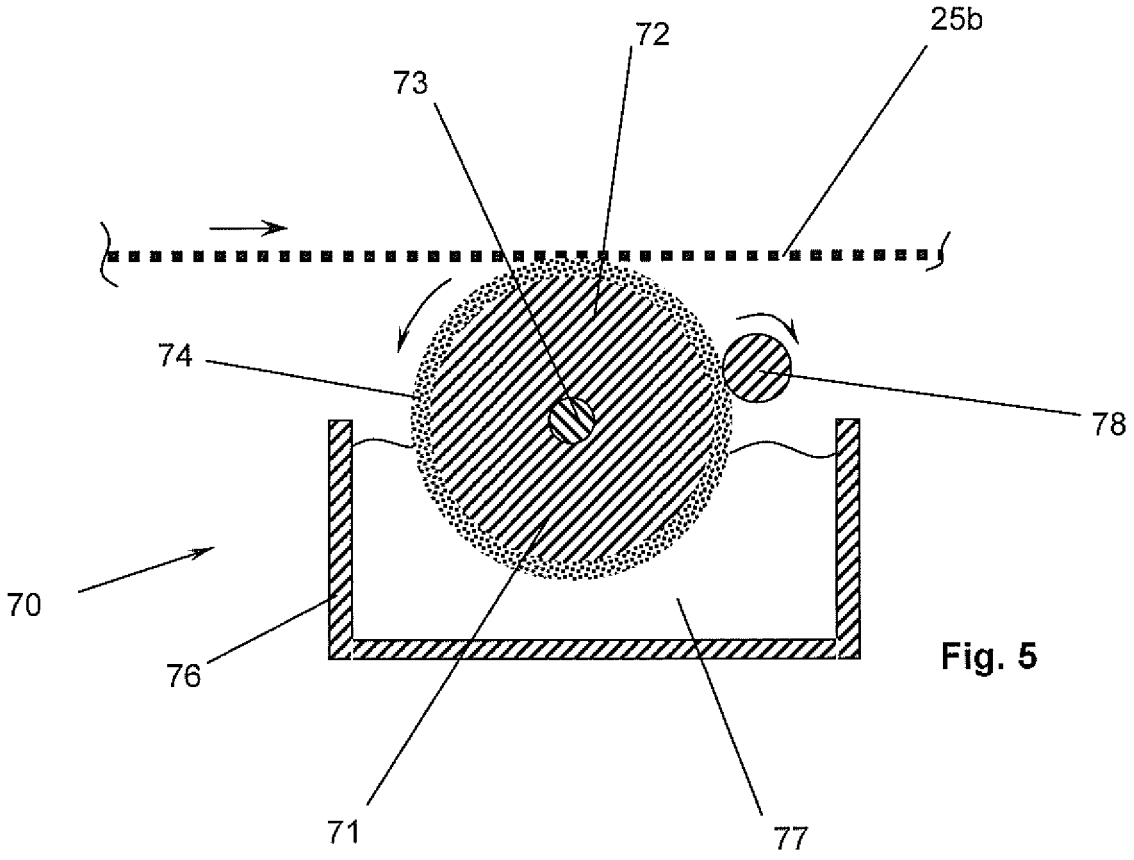

Further preferred embodiments are defined in the further sub-claims as well as in the embodiment which is now described in view of the figures. The figures show:

FIG. 1 a strongly schematic cross section through a laser cutting device in which an improved transport device according to the invention is installed, FIG. 2 a schematic view from direction R to the transport device of FIG. 2 without input- and output roller, FIG. 3 the detail D from FIG. 2 (but not drawn to scale) meaning a piece of expanded metal serving as conveyor belt, FIG. 4 a sectional view taking along plane A-A in FIG. 3, and FIG. 5 a preferred embodiment of a cleaning station.

FIG. 1 schematically shows a cross-sectional view of a device for producing laser cuts in flat paper blanks, such as greeting cards or the like. This device is comprised of four elements, namely a feed unit 40, a transport device 10, a laser 30 arranged above the transport device and a removal unit 50. The transport direction of the paper is the direction T, and the device can operate continuously, meaning the laser generates the cutout contours during a continuous transport movement of the transport device 10. FIG. 2 shows a plan view onto the transport device 10 of FIG. 1 from direction R.

The feed unit 40 can have a standard configuration, namely consisting of a table 42 with smooth surface and a number of transport rolls 44 which supply the paper blanks with a sliding movement across the table to the transport device 10. The angle of the transport rolls 44 can deviate slightly from a 90 degree angle, relative to the transport direction T (see FIG. 1*a*) and can press the paper blanks in such a way against an end stop that a more precise positioning of the paper blanks is achieved. The removal unit 50 can also have a standard configuration and, for example, can consist of a connecting piece 52 and a conveying belt 54. However, it would also be possible to provide a stacker or the like immediately downstream of the transport device 10.

The essential elements of the transport device 10 according to the invention are two rollers 12*a*, 12*b*, wherein at least one of the two rollers is driven by means of a motor 13, the rear roller 12*b* in this case, the conveyor belt 25, as well as a plurality of axial fans 16 which are arranged below the upper section (meaning the transport section) 25*a* of the conveyor belt 25. A support 14 that is positioned in the horizontal plane and essentially extends from the front roller 12*a* to the rear roller 12*b* serves to position these axial fans 16 (the axial fans 16 in principle can be designed in the same way as conventional fans used in computer casings). The support 14 is provided with a plurality of openings. The axial fans 16 are arranged at these openings, as shown only very schematically in FIG. 1. In praxis, the support 14 can also be embodied considerably thinner. The axial fans 16 are preferably positioned relatively close to the underside of the upper section 25*a* of the conveyor belt.

The axles 12*a*' and 12*b*' of the rollers are located in one plane and the axle 12*b*' of the driven roller 12*b* extends preferably exactly perpendicular to the transport direction T. The angle of the non-driven axle 12*a*' is changeable in order to prevent a lateral "running away" of the conveyer belt 25. Usually a few tenth of a degree around the neutral position (in which the non-driven axle 12*a*' is parallel to the driven axle 12*b*') is sufficient. It turned out that a conveyer belt 5 being made of expanded metal according to the invention would tend to do this if no countermeasures are taken. In order to be able to change this angle, an adjusting element 80 is provided which acts on a bearing 15 of the non-driven axle 12*a*'. This adjusting element 80 can for example be in form of a linear motor or a servo motor. The adjusting element 80 can be designed such that it allows a continuous adjustment of the angle of the axle or only a discreet adjustment of the same.

The adjusting element is controlled by the controller 82 which in turn receives information from at least one belt position sensor. In the embodiment shown, two belt position sensors are provided, namely a right belt position sensor 84 and a left belt position sensor 86. These belt position sensors can for example be designed as simple light barriers, which give a signal to the controller if an edge of the belt exceeds a pre-defined position to the outside. If a position exceeding to the right is signaled to the controller, the controller controls the adjusting element in such a way that the bearing 15 is moved into direction A leading to a movement of the belt back to the middle. If a position exceeding to the left is signaled to the controller, the controller controls the adjusting element in such a way that the bearing 15 is moved into direction B. So a simple control loop for centering of the conveyer belt is formed. Of course a more complicated (and maybe only one) belt position sensor could be used. Usually such a centering at one end of the belt (preferably at the non-driven end of the conveyer belt) is sufficient.

The adjusting device can be designed such that both movements are conducted actively, or the bearing 15 could be biased in one direction (for example by means of a spring).

According to the invention, the conveyer belt 25 is made as an expanded metal belt. For this purpose the end faces of an expanded metal strip of suitable length and width are connected to one another, especially by means of plasma- or laser welding. It is preferred that the expanded metal strip is calendered before the connecting takes place.

FIG. 3 shows a small section of a suitable expanded metal, FIG. 4 shows a cutting along plane A-A in FIG. 3. The through holes of the expanded metal are uniform rhombuses with a first axis A1 and a second axis A2. Preferably, the axes are not equally long and the shorter axes (here the first axes A1) show in transport direction T. By this, the conveyer belt is very flat between the rollers and nevertheless adapts to the radii of the rollers. Preferably, the length of the first axes A1 is between 1.5 mm and 4 mm and the length of the second axes is between 2.5 mm and 6 mm. The free cross section of the conveyer belt is preferably between 50% and 70%.

As can be seen in FIG. 4, the thickness of the expanded metal is slightly enlarged in the "knots" which are located between four through holes, such that a flat first surface 26*a* and a second surface 26*b* with slight elevations 26*b*' result. This structure results by many calendered expanded metals automatically. The face sides of the expanded metal are connected to form the conveyer belt in such a way that the first surface 26*a* points to the inside and the second surface 26*b* points to the outside, such that the conveyed sheets rest in the transport section 25*a* exclusively on those elevations 26*b*'. This has inter alia advantages in view of the back-reflection of the laser beams.

The total tightness $d_g$ of the expanded metal is preferably between 0.2 mm and 0.5 mm. The expanded metal preferably consists of stainless steel.

Optionally, the transport device 10 can additionally comprise the following elements: input rollers 23, an output roller 20 and a lower cleaning brush 22 or a cleaning station. A preferred embodiment of such a cleaning station is explained later in view to FIG. 5.

A cutting laser 30 is located above the transport device 10.

The device preferably operates continuously, as previously mentioned, and at a constant transporting speed. As a result of the axial fans 16, which suck in air through the upper section 25*a* of the conveyor belt 25, the paper blanks which are supplied by the feed unit 40 in a precise position are held in this position. The air ejected by the axial fans 16 exits through the lower section 25*b* of the conveyor belt and thus also contributes to a cleaning of the return section of the conveyor belt 25. Providing axial fans instead of a suction box furthermore has the additional great advantages of requiring considerably less energy and resulting in a noticeably lower noise development (traditional suction boxes generally use radial compressors as vacuum generators).

The laser 30 cuts the paper blanks, positioned on the upper section of the conveyor belt, which then leave the transport device 10 at the rear roller 12*b* and are discharged via the discharge unit 50.

To be able to tension the conveyor belt 25, at least one end of each side face comprises a slot 19 that extends in transport direction and through which the axle of a roller—in this case the front roller 12*a*—extends, so that the distance between the rollers 12*a*, 12*b* can be changed and the conveyor belt 25 can thus be tensioned. This is not described in detail here, but known from generic WO 2014/121939 A1. The conveyor belt 25 can therefore also be installed in the fully assembled state, meaning in the state where it is welded together to form an endless loop, wherein it is fitted on by pushing it from the side onto the rollers 12*a*, 12*b*. For this, additional units such as the intake rollers 23 and the like may have to be dismantled if applicable.

FIG. 5 show a preferred embodiment of a cleaning station 70 which can be arranged below the return section 25 of the conveyor belt 25, for example at the location of the above-mentioned cleaning brush 22. This cleaning station 70 comprises a cleaning roller 71, driven around an axis 73, and a container 76 that is open on the top for holding cleaning liquid 77 (water in the simplest case). A strip roller 78 is preferably also provided, which is driven in the opposite direction as the cleaning roller. At least the outer shell layer of the cleaning roller 71 is embodied as a sponge (sponge shell 74—FIG. 11) or in the form of a brush (brush shell 75—FIG. 12). The cleaning roller 71 is advantageously driven to rotate in the same direction as the rollers 12*a*, 12*b*.

The cleaning roller 71 is positioned such that it presses from below against the return section 25*b* of the conveyor belt 25 while a lower portion of this roller is submerged in the cleaning fluid 77. As a result of the rotation of the cleaning roller, new cleaning fluid 77 is constantly absorbed and conveyed to the return section 25*b* of the conveyor belt. The degree of moistening of the return section can be adjusted with the strip roller which is arranged in rotational direction of the cleaning roller between the cleaning fluid and the conveyor belt. It is preferable in that case if the radial distance between the cleaning roller and the strip roller 78 is adjustable.

The moist or wet cleaning (in particular with the aid of the above-described cleaning station) has several advantages. Above all, it is possible to achieve a good cleaning of the conveyor belt to remove burning residue, ash and the like. The moistening of the conveyor belt as such furthermore also has advantages. On the one hand, it generates cold by evaporation—which is additionally helped by the arrangement of the axial fans—meaning it results in a cooling of the conveyor belt, the upper section 25*a* of which is admitted with laser energy. The degree of moistening can furthermore be adjusted, such that a certain amount of liquid still adheres to the upper section 25*a* of the conveyor belt. This remaining liquid improves the adhesion of burn residue, ash and the like, thereby preventing these residues from dirtying the back side of the paper to be processed. The mesh structure of the metal conveyor belt strongly favors the desired adherence of liquid.

Finally, it should be mentioned that the described processing device not only useful for the processing of paper, but also for the processing of other flat elements such as, for example cardboard, corrugated cardboard, textiles, leather, or plastic foils.

The invention claimed is:

1. A device for processing flat elements including paper blanks, comprising:

a transport device and a laser for cutting of the flat elements, wherein the transport device comprises a conveyor belt that is guided over a first pulley and a second pulley, said conveyor belt being made of metal and being permeable to air, wherein an upper section of said conveyor belt forms a transport section, and a lower section of said conveyor belt forms a return section, and wherein the laser is located above the transport section, characterized in that the conveyor belt consists of an expanded metal, and that a free cross-section of the expanded metal is between 50% and 70%.

2. The device according to claim 1, characterized in that the conveyor belt is produced from a strip of expanded metal consisting of steel.

3. The device according to claim 2, characterized in that the strip of expanded metal is calendered.

4. The device according to claim 2, characterized in that face ends of the strip of expanded metal are plasma- or laser-welded.

5. The device according to claim 1, characterized in that the conveyor belt has a thickness between 0.2 mm and 0.5 mm.

6. The device according to claim 1, characterized in that between the transport section and the return section at least one vacuum generator is located.

7. A device for processing flat elements including paper blanks, the device comprising:

a transport device and a laser for cutting of the flat elements, wherein the transport device comprises a conveyor belt that is guided over a first pulley and a second pulley, said conveyor belt being made of metal and being permeable to air, wherein an upper section of said conveyor belt forms a transport section, and a lower section of said conveyor belt forms a return section, and wherein the laser is located above the transport section, characterized in that the conveyor belt consists of an expanded metal, which includes a plurality of through-holes that are uniform and uniformly orientated rhombuses, such that each rhombus has a first axis and a second axis, wherein the first axes are orientated in transport direction and the second axes are orientated perpendicular to the transport direction.

8. The device according to claim 7, characterized in that at least the outer surface of the conveyor belt shows elevations at the junctions at which four rhombuses meet.

9. The device according to claim 7, characterized in that the first axes are shorter than the second axes.

10. The device according to claim 7, characterized in that the first axes have a length between 1.5 mm and 4 mm and the second axes have a length between 2.5 mm and 6 mm.

11. A device for processing flat elements including paper blanks, the device comprising:

a transport device and a laser for cutting of the flat elements, wherein the transport device comprises a conveyor belt that is guided over a first pulley and a second pulley, said conveyor belt being made of metal and being permeable to air, wherein an upper section of said conveyor belt forms a transport section, and a lower section of said conveyor belt forms a return section, and wherein the laser is located above the transport section, characterized in that the conveyor belt consists of an expanded metal, and axles of the two pulleys are located in one plane, at least the axle of the first pulley being pivotable within this plane, such that the angle between the two axles of the pulleys is changeable.

12. The device according to claim 11, characterized in that the first pulley is not driven and the second pulley is driven.

13. The device according to claim 11, characterized in that at least one sensor for determining the transverse position of the conveyor belt at at least one position is provided and that an adjusting element acting onto the axle of the first pulley is provided, said adjusting element changing the angle of the axle in relation to the transport direction in dependence of the belt position determined by the at least one sensor.

14. A device for processing flat elements including paper blanks, the device comprising:

a transport device and a laser for cutting of the flat elements, wherein the transport device comprises a conveyor belt that is guided over a first pulley and a second pulley, said conveyor belt being made of metal and being permeable to air, wherein an upper section of said conveyor belt forms a transport section, and a lower section of said conveyor belt forms a return section, and wherein the laser is located above the transport section, characterized in that the conveyor belt consists of an expanded metal, and at least one cleaning device acting onto the return section is provided.

15. The device according to claim 14, characterized in that the cleaning device moistens the conveyor belt.

16. The transport device according to claim 15, characterized in that the cleaning device is embodied as a cleaning station, provided with a cleaning roller that can be driven and a container that is open on the top and can be filled with liquid, wherein the cleaning roller is positioned such that an upper section of its surface comes in contact with the return section of the conveyor belt and that a lower section of the cleaning roller is located inside the container.

17. The transport device according to claim 16, characterized in that the axis of the cleaning roller extends parallel to the axes of the rollers.

18. The transport device according to claim 17, characterized in that the cleaning roller is driven in the same rotational direction as the rollers.

19. The transport device according to claim 16, characterized in that a strip roller is furthermore provided which extends parallel to the cleaning roller but is advantageously driven in counter direction to the cleaning roller and comes in contact with a section of the surface of the cleaning roller.

* * * * *